US010271654B2

(12) United States Patent
Mitschke et al.

(10) Patent No.: US 10,271,654 B2
(45) Date of Patent: Apr. 30, 2019

(54) SEATING/RECLINING-FURNITURE

(71) Applicant: himolla Polstermöbel GmbH, Taufkirchen / Vils (DE)

(72) Inventors: Helmut Mitschke, Taufkirchen/Vils (DE); Robert Brandhuber, Neufraunhofen (DE)

(73) Assignee: HIMOLLA POLSTERMÖBEL GMBH, Taufkirchen/Vils (DE)

( * ) Notice: Subject to any disclaimer, the term of this patent is extended or adjusted under 35 U.S.C. 154(b) by 81 days.

(21) Appl. No.: 15/405,980

(22) Filed: Jan. 13, 2017

(65) Prior Publication Data

US 2017/0202354 A1 Jul. 20, 2017

(30) Foreign Application Priority Data

Jan. 15, 2016 (DE) ..... 10 2016 100 664
Jan. 15, 2016 (DE) ..... 20 2016 100 188 U

(51) Int. Cl.

| | |
|---|---|
| ***A47C 3/30*** | (2006.01) |
| ***A47C 1/034*** | (2006.01) |
| ***A47C 3/023*** | (2006.01) |
| ***A47C 7/00*** | (2006.01) |

(52) U.S. Cl.

CPC ..... *A47C 1/0342* (2013.01); *A47C 3/023* (2013.01); *A47C 3/30* (2013.01); *A47C 7/004* (2013.01)

(58) Field of Classification Search

CPC ..... A47C 7/50; A47C 7/506; A47C 7/004; A47C 1/0355; A47C 1/0345; A47C 1/0342; A47C 3/30

USPC ..... 297/423.28

See application file for complete search history.

(56) References Cited

U.S. PATENT DOCUMENTS

2002/0113477 A1* 8/2002 Uchiyama ..... A47C 1/0242 297/330
2002/0149238 A1* 10/2002 Hoffman ..... A47C 1/03255 297/85 R
2004/0012231 A1* 1/2004 Hesse ..... A47C 1/0355 297/85 M (Continued)

FOREIGN PATENT DOCUMENTS

DE 8604479 U1 2/1986
DE 102013219659 A1 4/2015
DE 202015105851 U1 12/2015

OTHER PUBLICATIONS

Communication received from the German Patent and Trademark Office for related German Application No. 102016100664.5; dated Apr. 9, 2018; 2 pages.

(Continued)

*Primary Examiner* — Mark R Wendell
(74) *Attorney, Agent, or Firm* — Cantor Colburn LLP

(57) ABSTRACT

The invention relates to seating/reclining furniture, in particular an armchair or a chair, having a back part, a seat part and an adjustable footrest arrangement that is pivotable relative to the seat part between an inwardly folded basic position beneath a seating surface of the seat part and an outwardly folded position of use, wherein the footrest arrangement comprises a frame and a foot part pivotable relative to the frame, and wherein an adjustment member variable in length by means of an actuating motor for pivoting the foot part is supported at a front cross strut fixed to a frame and is connected to a movable rear adjustment traverse.

14 Claims, 10 Drawing Sheets

(56) References Cited

U.S. PATENT DOCUMENTS

| | | | | |
|---|---|---|---|---|
| 2008/0012405 | A1* | 1/2008 | Dewert | A47C 1/0242 297/217.3 |
| 2011/0043005 | A1* | 2/2011 | Fischer | A47C 7/506 297/68 |
| 2011/0298249 | A1* | 12/2011 | Kuno | A47C 7/506 297/75 |
| 2014/0049078 | A1* | 2/2014 | Hortig | A47C 1/034 297/68 |
| 2014/0292052 | A1* | 10/2014 | Parker | A47C 7/38 297/342 |
| 2015/0021969 | A1* | 1/2015 | Yin | B64D 11/0643 297/423.26 |
| 2015/0208805 | A1 | 7/2015 | Griggs | |
| 2015/0305507 | A1* | 10/2015 | Besler | A47C 7/506 297/423.28 |
| 2016/0045031 | A1* | 2/2016 | Lawson | A47C 1/0345 297/284.3 |
| 2017/0013961 | A1* | 1/2017 | LaPointe | A47C 1/0352 |
| 2017/0296410 | A1* | 10/2017 | Feldman | A61G 5/14 |
| 2017/0332787 | A1* | 11/2017 | Brandhuber | A47C 1/0355 |

OTHER PUBLICATIONS

Communication received from the European Patent Office for related EP Application No. 17151292.4, dated Aug. 28, 2018, 3 pages.

Directive 2009/144/EC of the European Parliament and of the Council, Certain Components and Characteristics of Wheeled Agricultural or Forestry Tractors, Nov. 30, 2009.

* cited by examiner

SEATING/RECLINING-FURNITURE

CROSS REFERENCE TO RELATED APPLICATIONS

This claims priority to DE102016100664.5 filed 15 Jan. 2016 and DE202016100188.9 filed 15 Jan. 2016, both of which are hereby incorporated by reference in their entirety.

A first aspect of the invention relates to seating/reclining furniture, in particular to an armchair or a chair, having a back part, a seat part and an adjustable footrest arrangement that is pivotable between an inwardly folded basic position beneath a seating surface of the seat part and an outwardly folded position of use relative to the seat part.

Such furniture is generally known. To increase the comfort for a user, it is desirable to configure the footrest arrangement of such a piece of furniture as adjustable by a motor. The limited construction space that is available beneath the seating surface or beneath the seat part of the piece of furniture is a problem in this respect.

It is therefore an object of the invention to further develop seating/reclining furniture of the above-named kind such that the footrest arrangement is adjustable by a motor without the functionality and the possibilities for use of the footrest arrangement thereby being impaired.

This object is satisfied by seating/reclining furniture having the features of claim 1. In accordance with the invention, an adjustment member that can be varied in length by means of an actuating motor is supported at a front cross strut fixed to a frame and is connected to a rear actuation member that is rotatable relative to the frame, wherein the actuation member is connected to the foot part via an adjustment arrangement.

In accordance with the invention, the adjustment member variable in length is effective between the front cross strut and the rotatable rear actuation member. Such an installation concept for an adjustment member that can be operated by a motor allows a space-saving integration, whereby it only becomes possible at all to integrate a footrest arrangement adjustable by a motor into seating/reclining furniture such that neither the functionality nor the possibilities for use of the footrest arrangement are impaired.

The actuation member can comprise a crossbar that is rotatably supported at the frame, that is rotatable by means of the adjustment member and whose rotation can be converted into an adjustment movement of the adjustment arrangement. Such an actuation concept can be implemented in a particularly simple and space-saving manner. In addition, such footrest arrangements can hereby be powered in which to date the crossbar has been set into rotation by means of a lever to be actuated by a user to actuate the adjustment arrangement and to pivot the foot part.

The adjustment member can be pivotally connected to an actuation tab rotationally fixedly connected to the crossbar. This allows a space-saving actuation of the crossbar by an adjustment member provided with an actuating motor.

Provision is preferably made that a pivot axle about which the adjustment member and the actuation tab are pivotable relative to one another does not intersect a longitudinal axis along which the adjustment member is variable in length. The movement of the adjustment member variable in length can hereby be particularly effectively converted via the actuation tab into a rotation of the crossbar and thus into an action on the adjustment member for the foot part.

The adjustment member can comprise an actuating motor and a housing having a control element that can be moved in and out by means of the actuating motor, wherein the actuating motor, the housing and the control element are arranged between the front cross strut and the rear actuation member.

The actuating motor can, for example, be a spindle motor having limit switches corresponding to the inwardly folded basic position and to the outwardly folded position of use. The actuating motor can e.g. be installed offset in parallel with the longitudinal axis along which the adjustment member is variable in length and can cooperate via a suitable transmission with a spindle that extends along this longitudinal axis, that forms the inwardly and outwardly movable control element, that is a component of the control element or that is connected to the control element.

The frame can comprise a left side strut and a right side strut, wherein the side struts are connected to one another via the front cross strut.

The foot part can have a foot support that is movable between an inwardly moved basic position and an outwardly moved position of use relative to the foot part, wherein the movement of the foot support, which is in particular a pushing movement in a plane, is derived from the pivot movement of the foot part. The foot part located in the position of use can advantageously be extended by such a foot support.

The first aspect of the invention additionally relates to an adjustable footrest arrangement for seating/reclining furniture, wherein the footrest arrangement is pivotable between an inwardly folded basic position and an outwardly folded position of use, wherein the footrest arrangement comprises a frame and a foot part pivotable relative to the frame, wherein, for the pivoting of the foot part, an adjustment member variable in length by means of an actuating motor is supported at a front cross strut fixed a the frame and is connected to a rear actuation member rotatable relative to the frame, and wherein the actuation member is connected to the foot part via an adjustment arrangement.

A second aspect of the invention relates to seating/reclining furniture, in particular to an armchair or a chair, having a back part, a seat part, and a footrest arrangement that is adjustable by a motor and that is pivotable relative to the seat part between an inwardly folded basic position beneath a seating surface of the seat part and an outwardly folded position of use, wherein the footrest arrangement comprises a frame and a foot part pivotable relative to the frame.

Such furniture is generally known. It is disadvantageous with known pieces of furniture of this kind that the footrest arrangement requires a comparatively large installation depth beneath the seating surface or beneath the seat part in the inwardly folded basic position and consequently projects relatively far to the rear. For some pieces of furniture, in particular for certain armchairs that are also called relax chairs and in particular have a cantilever chair structure, it is desirable both for construction reasons and with respect to the design that the back part extends up to and beneath the seating surface or up to and beneath the seat part. A footrest arrangement having a comparatively large installation depth is then in the way of such a back part pulled downwardly.

It is therefore a further object of the invention to provide seating/reclining furniture of the above-named kind in which the footrest arrangement has a comparatively small construction depth without the functionality and the possibilities for use of the footrest arrangement thereby being impaired.

This further object is satisfied by seating/reclining furniture having the features of claim 8. In accordance with the invention, an adjustment member that can be varied in length by means of an actuating motor for pivoting the foot part is supported at front cross strut fixed to a frame and is connected to a movable rear adjustment traverse, wherein the adjustment traverse is connected to the foot part via an adjustment arrangement.

In accordance with the invention, the adjustment member variable in length is effective between the front cross strut and the movable rear traverse. The adjustment member for moving the adjustment traverse consequently does not have to support itself e.g. at a cross strut of the frame located behind the movable adjustment traverse. The adjustment member for moving the rear adjustment traverse can rather be supported at the front cross strut, that is in front of the movable adjustment traverse. The adjustment traverse consequently does not have to be pulled to the rear for a movement of the adjustment traverse to the rear, for example, but can rather be pressed to the rear.

The second aspect of the invention consequently utilizes the construction space present in front of the movable adjustment traverse for the adjustment member. The frame can hereby be formed in a short form in the rear region or can be kept free between side struts of the frame. It is thereby possible that the rear part can extend up to and beneath the seating surface or up to and beneath the seat part without the rear region of the footrest arrangement being in the way. The second aspect of the invention therefore allows seating furniture such as in particular a relax chair to be provided, despite the presence of a footrest arrangement adjustable by a motor, whose backrest is pulled downwardly up to and beneath the seating surface or the seat part.

The adjustment member can comprise the actuating motor and a housing having a control element that can be moved in and out by means of the actuating motor, wherein the actuating motor, the housing and the control element are arranged between the front cross strut and the rear adjustment traverse.

The actuating motor can, for example, be a spindle motor having limit switches corresponding to an inwardly folded basic position and to the outwardly folded position of use. The actuating motor can e.g. be installed in the transverse direction and can cooperate via a suitable transmission with a spindle that extends in the longitudinal direction, that is from the front to the rear, that forms the inwardly and outwardly movable control element, that is a component of the control element or that is connected to the control element.

The frame can comprise a left side strut and a right side strut, wherein the side struts are connected to one another via the front cross strut.

The rear adjustment traverse can respectively be connected via one or more mutually connected articulated levers to the side struts of the frame.

The frame is in particular substantially of U shape and is open to the rear.

The foot part can have a foot support that is movable between an inwardly moved basic position and an outwardly moved position of use relative to the foot part, wherein the movement of the foot support, which is in particular a sliding movement in a plane, is derived from the pivot movement of the foot part. The foot part located in the position of use can advantageously be extended by such a foot support.

A construction space for the footrest arrangement can be provided beneath the seating surface of the seat part and is bounded to the rear by the back part extending up to and beneath the seating surface or up to and beneath the seat part.

The back part can be connected to the seat part pivotable about a pivot axle and adjustable in inclination with respect to the seat part.

A cantilever chair support structure can be provided which supports the seat part and the back part and which has at least one support hoop which comprises a base section, an at least approximately horizontally extending horizontal section as well as a articulated section connecting the base section and the horizontal section to one another and allowing a pivoting of the horizontal section relative to the base section, wherein the back part is supported at the horizontal section pivotable about a horizontal axis and the seat part is movably guided in a compulsory manner along the articulated section.

The second aspect of the invention additionally relates to a footrest arrangement that is adjustable by a motor for seating/reclining furniture, wherein the footrest arrangement is pivotable between an inwardly folded basic position and an outwardly folded position of use, wherein the footrest arrangement comprises a frame and a foot part pivotable relative to the frame, wherein, for the pivoting of the foot part, an adjustment member variable in length by means of an actuating motor is supported at a front cross strut fixed to the frame and is connected to a movable adjustment traverse, and wherein the adjustment traverse is connected to the foot part via an adjustment arrangement.

Further developments of the seating/reclining furniture in accordance with the invention disclosed herein can also be provided for the footrest arrangements in accordance with the invention if these further developments relate to the respective footrest arrangement.

Possible embodiments of both the seating/reclining furniture in accordance with the invention and the footrest arrangements in accordance with the invention are also indicated in the dependent claims, in the description and in the Figures.

The invention will be described in the following by way of example with reference to FIGS. 1 to 15.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

FIGS. 1 and 2 show an embodiment of seating/reclining furniture in accordance with the invention. It is a so-called relax chair that has a seat part 13 having a seating surface 15 and a back part 11. The seat part 13 and the back part 11 are supported by a foot 43 that is here formed as a so-called star base, but can generally also be of a different design.

The seat part 13 is supported at the perpendicular column of the foot 43 via a gas pressure spring, not shown, for which a recess, not shown here, is provided (cf. FIGS. 4 to 8) that is integrated into a footrest arrangement (cf. FIGS. 3 to 8) to which the seat part 13 is attached. The seat part can be vertically adjusted by means of the gas pressure spring. The footrest arrangement is located beneath the seating surface 15 or beneath the seat part 13.

This concept of a combination of a footrest arrangement and of a vertical seat adjustment is generally known so that it will not be looked at in any more detail here.

Figure 1:
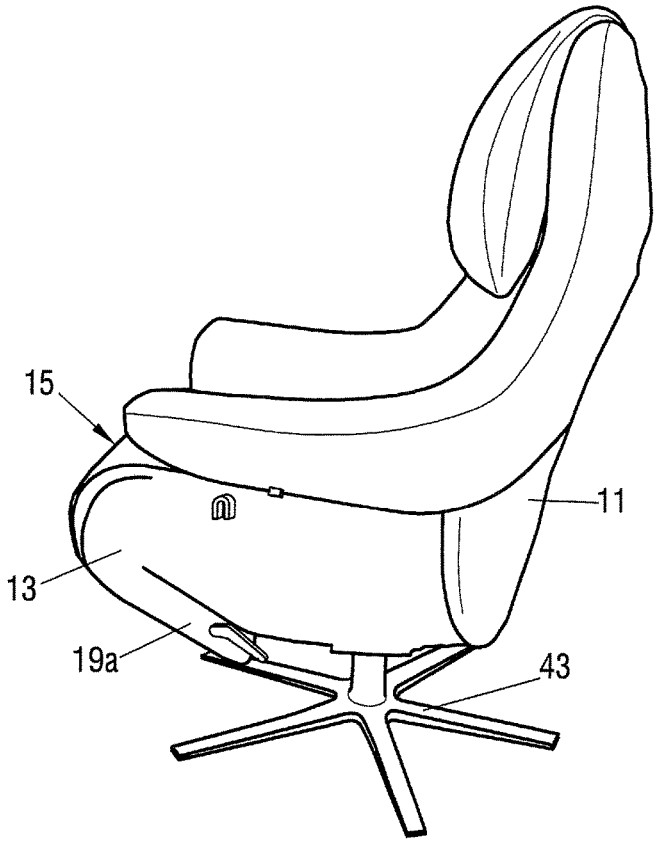
FIG. 1 shows a perspective view of a seating/reclining furniture in accordance with a first embodiment of the invention.
Figure 2:
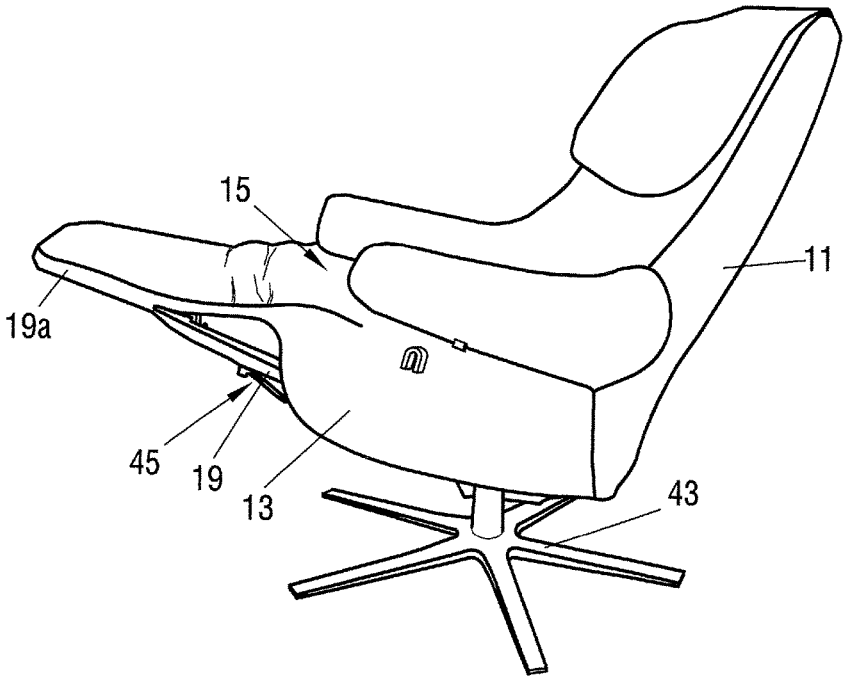
FIG. 2 shows the furniture of FIG. 1 wherein the foot part is outwardly folded.

The seating/reclining furniture in accordance with the invention is furthermore provided with a seat lowering function that is likewise generally known. This is coupled to the adjustment movement of a foot part 19 (FIG. 2) of the footrest arrangement, and indeed such that the seat part 13 is lowered in the rear region on the outward folding of the foot part 19 into the position of use in accordance with FIG. 2. The seating surface 15 of the seat part 13 is hereby inclined more to the rear, with the height of the seating surface 15 remaining substantially unchanged in the front region. The different seat inclination between the basic position with an inwardly folded foot part 19 in accordance with FIG. 1 and the position of use with an outwardly folded foot part 19 in accordance with FIG. 2 can be recognized by a comparison of FIGS. 1 and 2.

An additional foot support 19*a*, which extends the foot part 19 in the outwardly folded position of use of the footrest arrangement, is displaceable relative to the foot part 19.

A footrest arrangement having the above-explained functionality will be described in more detail in the following with reference to FIGS. 4 to 8.

Figure 3:
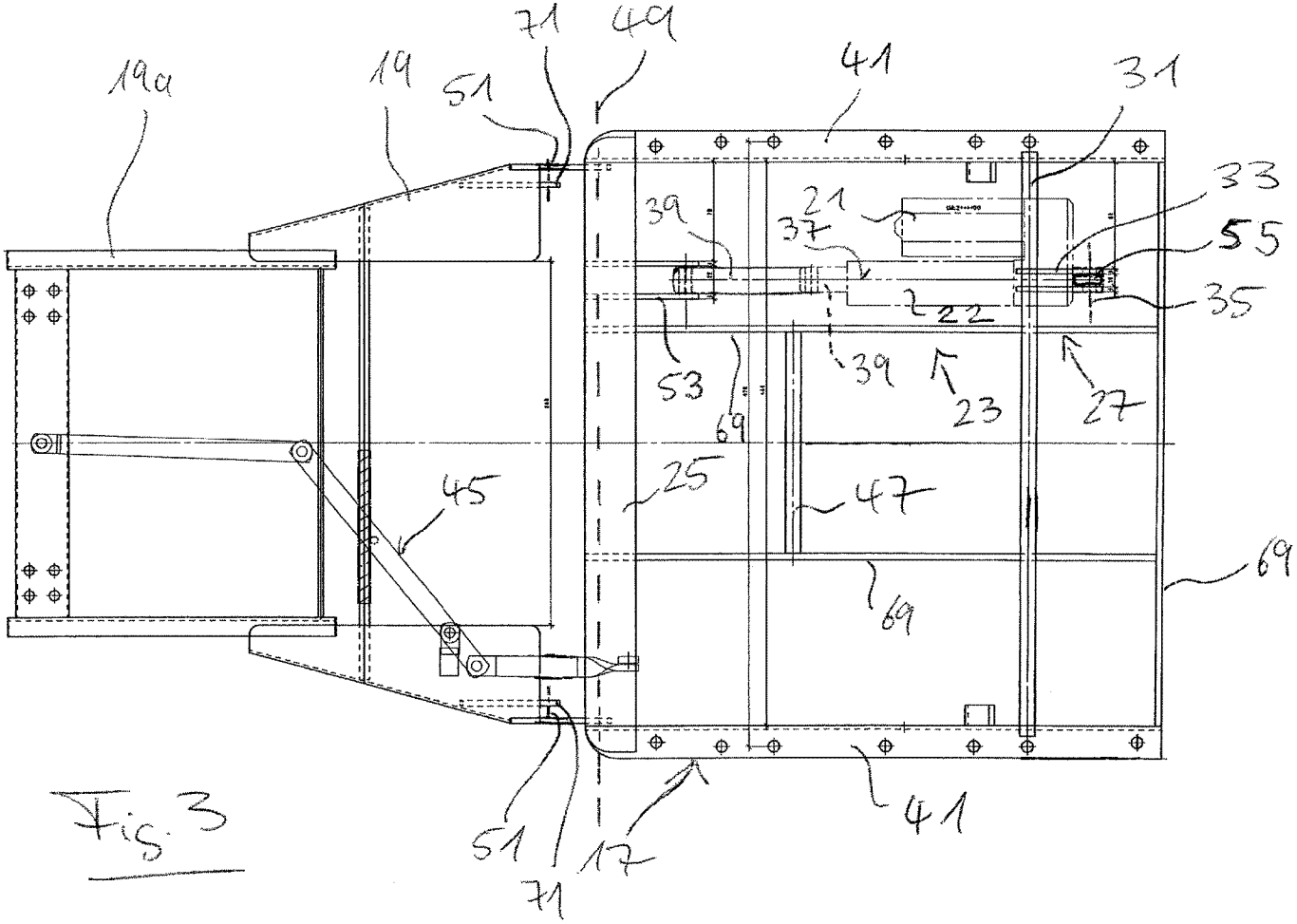
FIG. 3 shows a detailed plan view of a footrest arrangement in accordance with the invention.

FIG. 3 shows a plan view of a footrest arrangement in accordance with the invention that has a lever arrangement 45 that effects the displacement of the foot support 19*a* relative to the foot part 19 when the foot part 19 is pivoted relative to a frame 17. Such a concept is generally known so that it will not be looked at in any more detail.

Figure 4:
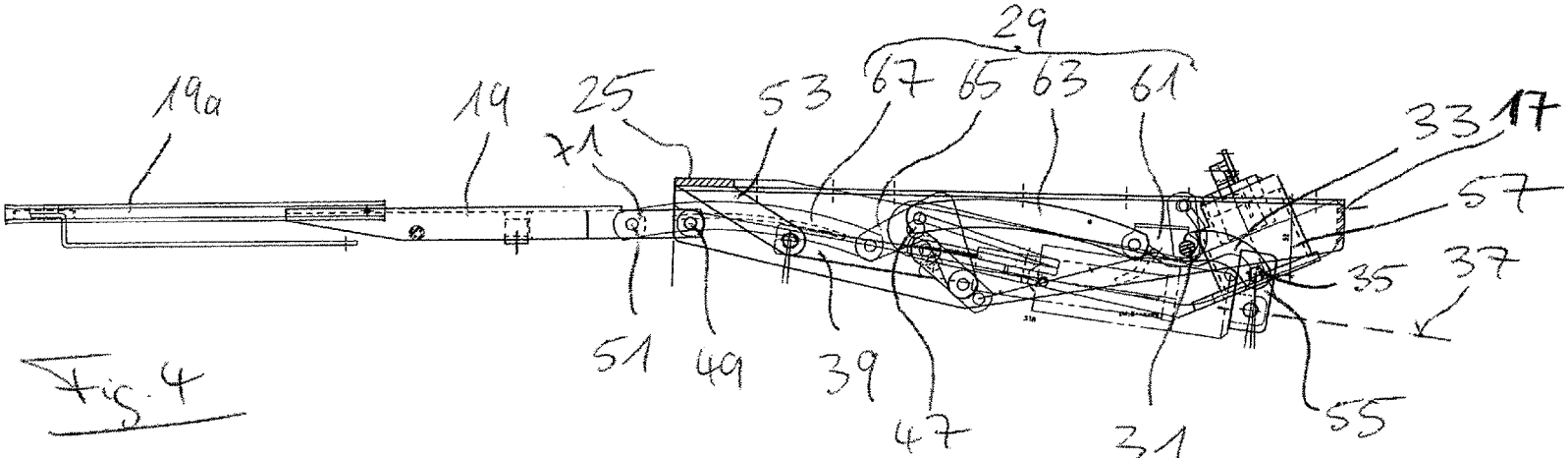
FIG. 4 shows a side view of the footrest arrangement of FIG. 3 in an outwardly folded position of use.
Figure 5:
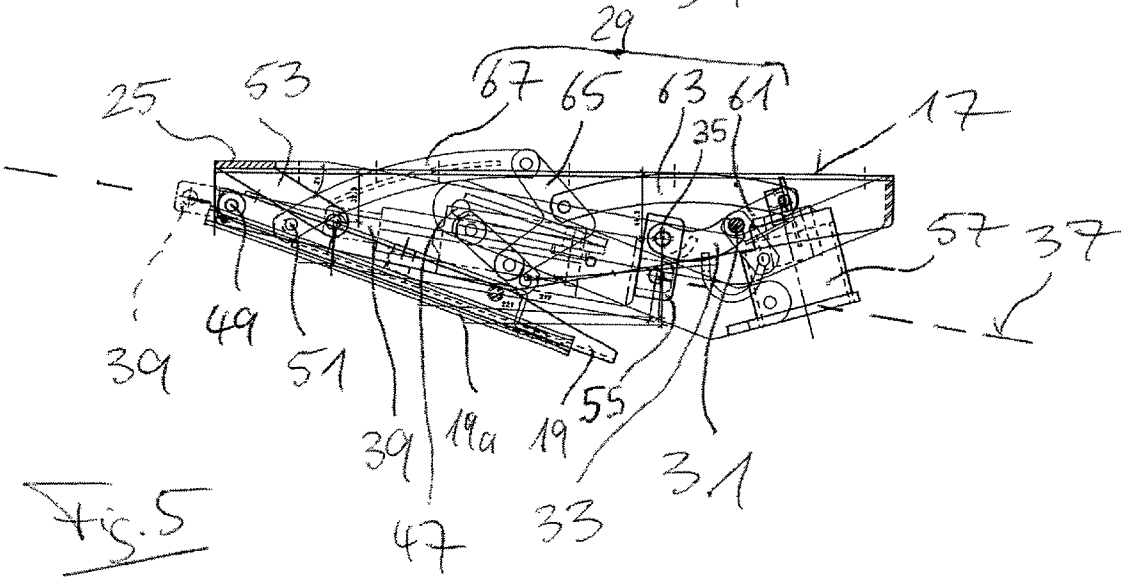
FIG. 5 shows a side view of the footrest arrangement of FIG. 3 in an inwardly folded basic position.

Side views of the footrest arrangement in accordance with FIG. 3 are shown in FIGS. 4 and 5. FIG. 4 shows the outwardly folded position of use, whereas FIG. 5 shows the inwardly folded basic position.

A cup-like, downwardly open recess 57 for the above-mentioned gas pressure spring for the vertical adjustment via which the footrest arrangement and thus the seat part 13 (FIGS. 1 and 2) are supported at the respective foot 43 of the seating/reclining furniture is not shown in FIG. 3, but is in contrast shown in FIGS. 4 and 5. The recess 57 is pivotable relative to the frame 17 about a rotating rod 47 that is coupled to struts 69 of the frame 17 extending in the longitudinal direction. These two struts 69 of the frame 17 are connected to a front cross strut 25 and to a rear strut 69 that are in turn connected to side struts 41 that serve for fastening the footrest arrangement to the seat part 13.

In the rear region, a crossbar 31 extends between the two side struts 41 and is rotatably supported at these two side struts 41. In a manner known per se, the crossbar is connected to the foot part 19 via an adjustment arrangement 29 not shown in FIG. 3, but shown in FIGS. 4 and 5, wherein the adjustment arrangement 29 comprises to the left and right in each case in the region of the side strut 41 a plurality of levers 61, 63, 65, 67 that are connected to one another in an articulated manner and that are pivotally connected to a tab 71 of the foot part 19. Front curved levers 67 of the adjustment arrangement 29 are each connected, to an axle 51 rotatable with the tab 71.

When the adjustment arrangement 29 acts on the foot part 19, the foot part 19 is pivoted about an axis 49 relative to the frame 17. This axis 49 extends in the region of the front cross strut 25 of the frame 17 and thus behind the axles 51 at which the front curved levers 67 of the adjustment arrangement 29 are each connected in an articulated manner to the foot part 19.

The adjustment arrangement 29 is effective when the crossbar 31 is rotated relative to the frame 17. For this purpose, short, straight rear levers 61 of the adjustment arrangement 29 are each rotationally fixedly connected to the crossbar 31.

The comparison of FIGS. 4 and 5 shows how the levers 61, 63, 65, 67 of the adjustment arrangement 29 pivot the foot part 19 on a rotation of the crossbar 31 between the outwardly folded position of use in accordance with FIG. 4 and the inwardly folded basic position in accordance with FIG. 5.

The rotation of the crossbar 31 takes place by an adjustment member 23 variable in length. The adjustment member 23 comprises an actuating motor 21 as well as a housing 22 having a control element 39 that can be moved in and out by means of the actuating motor 21. By moving the control element 39 in and out, the effective length of this adjustment member 23 is varied between the front cross strut 25 and a tab 55 attached to the rear end of the housing 22. For illustration, the end region of the control element 39 by which the control element 39 is coupled to a tab 53 projecting obliquely rearwardly downwardly from the front cross strut 25 is also shown in the inwardly moved (FIG. 3) or outwardly moved (FIG. 5) position with respect to the housing 22. This illustrates the possible length variation of the adjustment member 23 formed by the motor 21, the housing 22 and the control element 29.

The tab 55 of the adjustment member 23 is coupled in an articulated manner to a curved actuation tab 33 that is connected at its other end rotationally fixedly to the crossbar 31 and that forms a rear actuation member 27 together with it.

The comparison of FIGS. 4 and 5 shows how the rear actuation tab 33 is pivoted by a length variation of the adjustment member 23, how thereby a rotation of the crossbar 31 is effected and how hereby the foot part 19 is pivoted via the adjustment arrangement 29.

To fold the foot part 19 inwardly starting from the outwardly folded position of use in accordance with FIG. 4 into the basic position in accordance with FIG. 5, the control element 39 is moved in by means of the actuating motor 21. Since the control element 39 is supported at the front cross strut 25 fixed to the frame, the tab 55 is hereby pulled to the front along a longitudinal axis 37 of the adjustment member 23, whereby the actuation tab 33 is pivoted clockwise and the crossbar 31 is correspondingly rotated clockwise. To pivot the foot part 19 back into the position of use in accordance with FIG. 4 again, the control element 39 is moved out again, whereby the tab 55 pressed rearwardly along the longitudinal axis 37 in this respect pivots the actuation tab 33 counterclockwise and thus accordingly rotates the crossbar 31 counterclockwise.

To implement a sufficiently large adjustment path or pivot path, the spacing of a pivot axle 35 between the tab 55 of the adjustment member 23 and the actuation tab 33, on the one hand, and the longitudinal axis 37 of the adjustment member 23, on the other hand, and the shape and the length of the curved actuation tab 33 are dimensioned such that the adjustment member 23 can move to the front and to the rear beneath the crossbar 31, i.e. the adjustment member 23 can move past the crossbar 31. The adjustment member 23 does not have to engage directly at the crossbar 31 to be able to rotate it due to this design. In this manner, the adjustment path or stroke available by the length variation of the adjustment member 23 is converted into the rotation of the crossbar 31.

Figure 6:
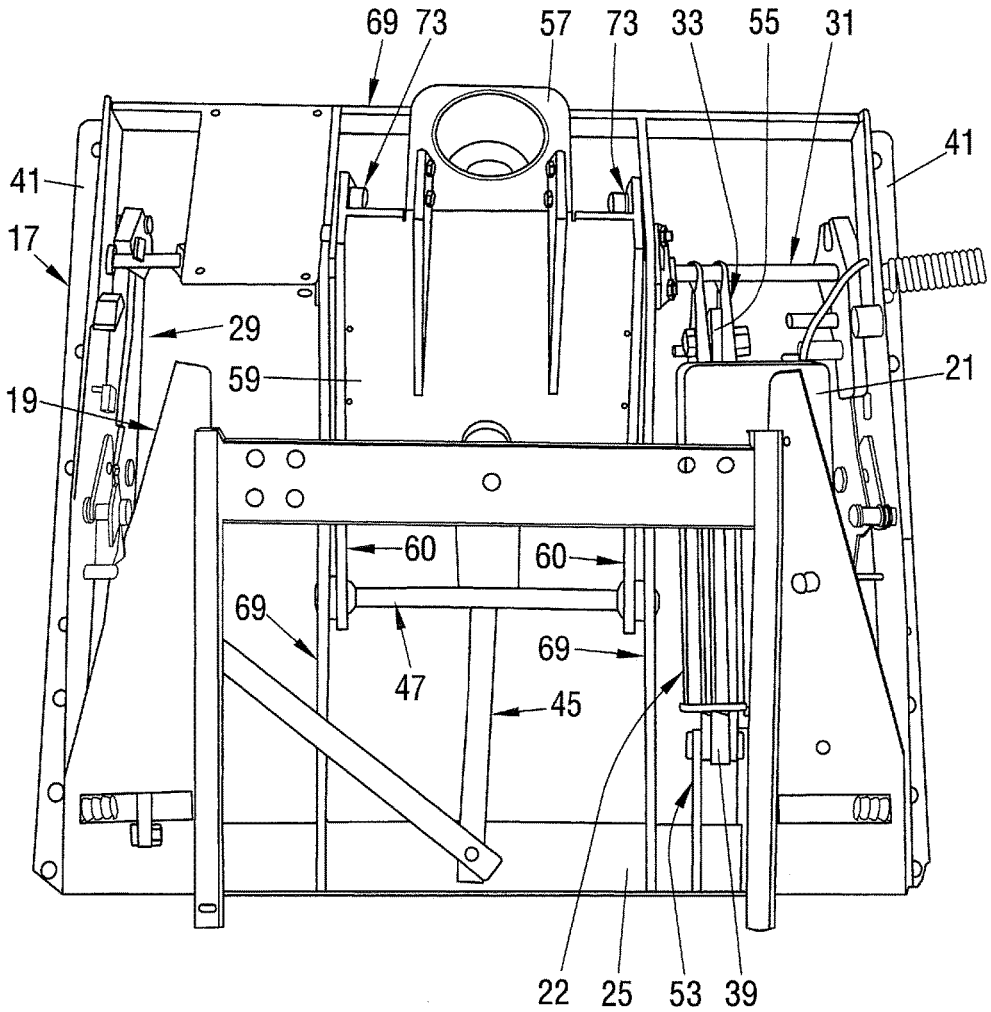
FIG. 6 to 8 correspond of FIGS. 3 to 5, each representing a view of the footrest arrangement from below.
Figure 7:
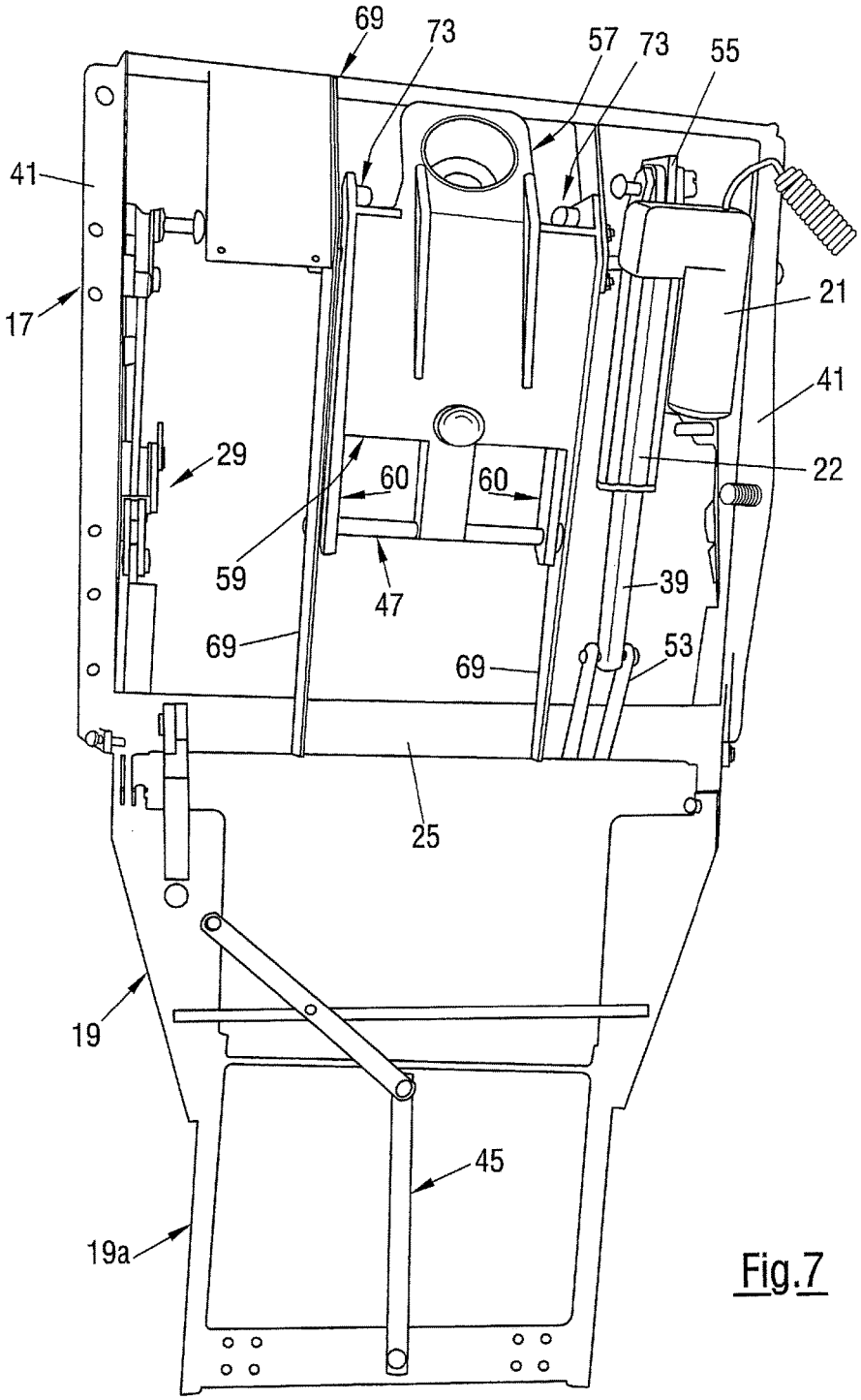
Figure 8:
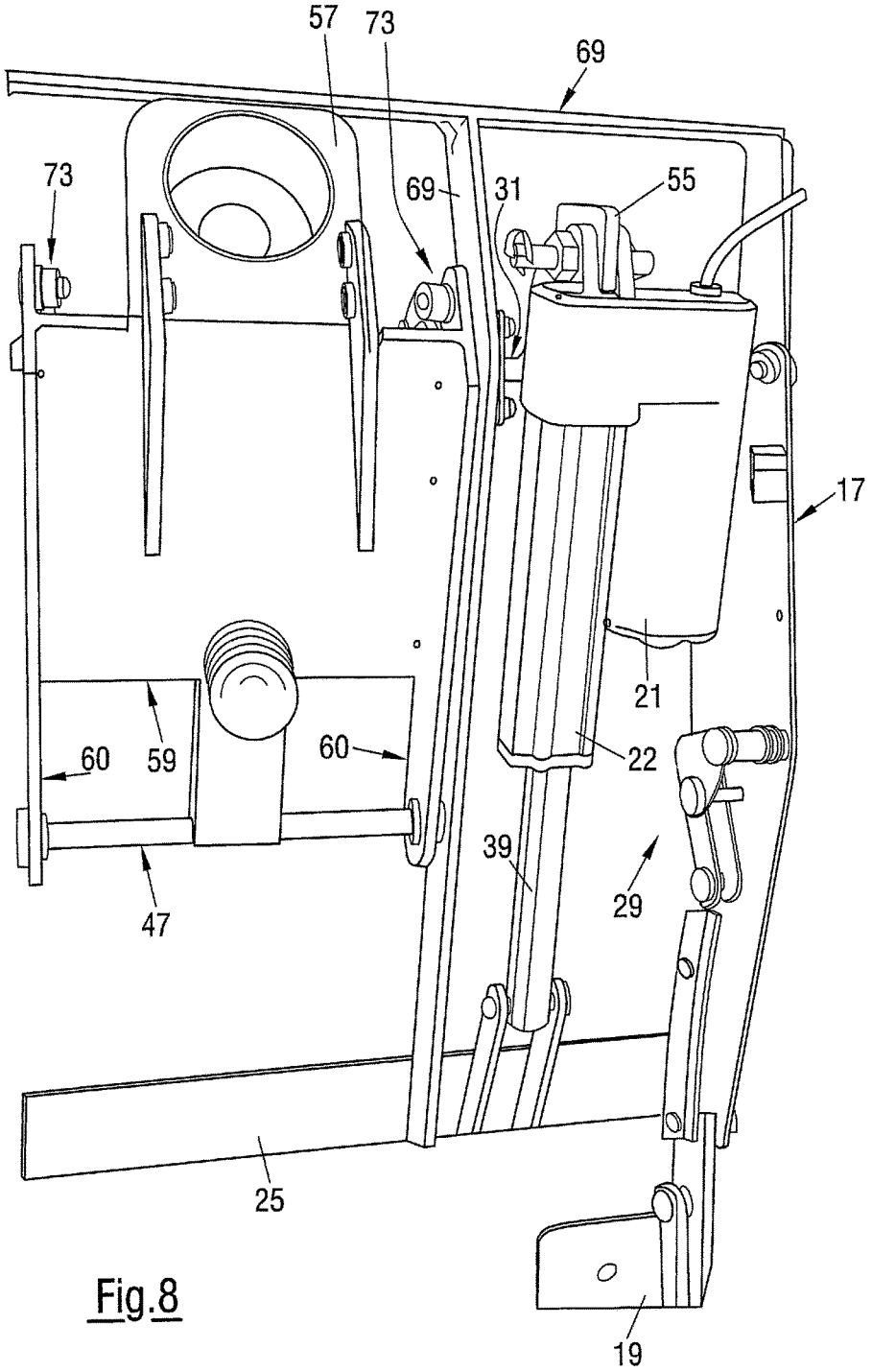

The embodiment of FIGS. 6 to 8 corresponds to the embodiment of FIGS. 3 to 5, with a different kind of representation being chosen. Components provided with the same reference numerals correspond to one another. Whereas FIG. 3 shows a plan view of the footrest arrangement in accordance with the invention from above, FIGS. 6 to 8 each represent a view of the footrest arrangement from below. The cup-shaped recess 57 for the above-mentioned gas pressure spring (not shown) serving for the vertical adjustment of the footrest arrangement and thus of the seat part 13 (FIGS. 1 and 2) can in particular respectively be recognized in FIGS. 6 to 8. The recess 57 is connected to a board 59 and via levers 60 to the rotating rod 47. The frame 17 fastened to the seat part 13, on the one hand, and the recess 57 supported at the foot 43 (FIGS. 1 and 2) of the seating/reclining furniture, on the other hand, are hereby pivotable relative to one another.

As already mentioned above, this pivot movement between the frame 17 and the recess 57 is effected by rotating the crossbar 31 that is connected via a lever arrangement 73 to the levers 60 that are in turn rotationally fixedly connected to the rotating rod 47 rotatably supported at the frame 17.

A rotation of the crossbar 31 by means of the adjustment member 23 in accordance with the invention consequently has two effects: Starting from the basic position (cf. also FIG. 1), the foot part 19 is outwardly folded and the foot support 19*a* is moved out, on the one hand, and the frame 17 is pivoted downwardly relative to the recess 57 about the rotating rod 47, on the other hand, whereby the seat part 13 is lowered, i.e. is given a greater inclination to the rear. This seat lowering is reversed when the foot part 19 is inwardly folded again by rotation the crossbar 31 in the opposite direction.

The adjustment of a foot part and the actuation of a mechanism for seat lowering thus take place simultaneously in accordance with the invention by a single, motor-powered adjustment arrangement that in particular engages at a common actuation member—at the crossbar 31 in the embodiment—wherein the actuation member is coupled both to the foot part and to the mechanism for the seat lowering.

Figure 9:
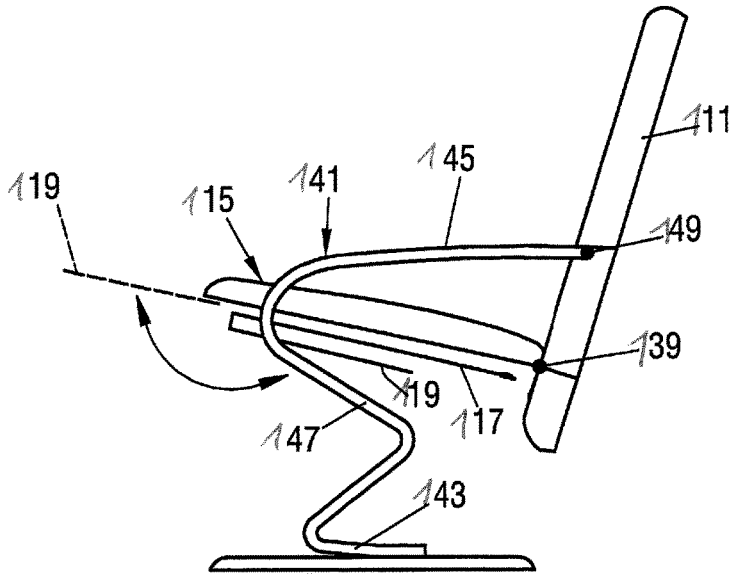
FIG. 9 shows a simplified side view of a seating/reclining furniture in accordance with a second embodiment of the invention.

FIG. 9 shows a simplified side view of an embodiment of seating/reclining furniture in accordance with the invention. It is in this respect a so-called relax chair having a cantilever chair support structure. This structure respectively comprises a support hoop 141 at the left side and at the right side that comprises a base section 143, an at least approximately horizontally extending horizontal section 145 and an articulated section 147 that connects the base section 143 and the horizontal section 145 to one another and allows a pivoting of the horizontal section 145 relative to the base section 143 and thus a "swinging" of the seat part 113 and of the back part 111. The back part 111 is pivotably supported about a horizontal axis 149 at the horizontal section 145. The seat part 113 is movably guided in a compulsory manner (not shown) along the articulated section 147.

A footrest arrangement in accordance with the invention that is located in an inwardly folded basic position is shown schematically by solid lines beneath the seat part 113. The footrest arrangement comprises a frame 117 fixedly connected to the seat part and a foot part 119 pivotable relative to the frame 117. In an outwardly folded position of use, the seat part 113 is extended by the outwardly folded foot part 119 indicated by a dashed line.

Such armchairs having a cantilever chair support structure are generally known. Since the back part 111 is pulled downwardly, that is extends up to and beneath the seating surface 115 or the seat part 113, only a limited installation depth is available for the footrest arrangement. It was previously not possible in such an installation position to provide a footrest arrangement that can be adjusted by a motor without impairing its functionality and its possibilities for use.

Figure 10:
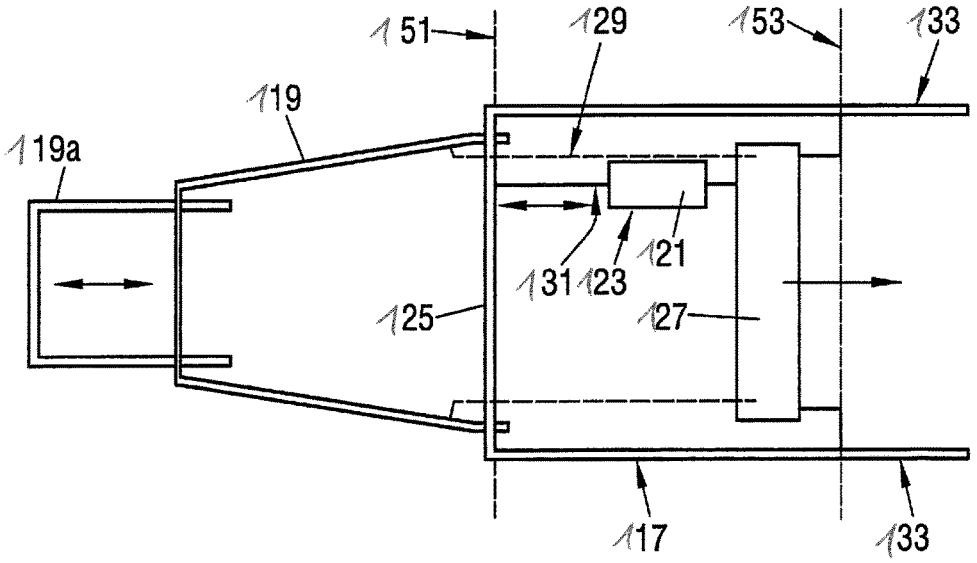
FIG. 10 shows a schematic plan view of another footrest arrangement in accordance with the invention.

FIG. 10 shows a schematic plan view of a footrest arrangement in accordance with the invention. The frame 117 comprises two side struts 133 that can be fastened to a seating/reclining part and that are connected to one another in the front region by a cross strut 125. The frame 117 is of U shape and is open to the rear. The foot part 119 is connected to the frame 117 pivotable about an axle 151. An additional foot support 119*a*, which extends the foot part 119 in the outwardly folded position of use of the footrest arrangement shown, is displaceable relative to the foot part 119, as indicated by the double arrow. The adjustment mechanism provided for this purpose and with which the sliding movement of the foot support 119*a* relative to the foot part 119 is derived from the pivot movement of the foot part 119 relative to the frame is not shown in FIG. 10.

The foot part 119 is coupled to the left and to the right by means of an adjustment arrangement 129 only indicated by dashed lines in FIG. 10 to an adjustment traverse 127 that extends in the region between the two side struts 133. This adjustment traverse 127 is movable relative to the side struts 133, and indeed pivotable about an axle 153 fixed with respect to the side struts 133. The coupling of the cross traverse 127 to the two side struts 133 takes place in each case by one or more articulated levers that are only shown schematically in FIG. 10.

An adjustment member 123 having an actuating motor 121 only indicated schematically and a control member 131 variable in length is effective between the front cross strut 125 fixed to the frame and the rear adjustment traverse 127, The adjustment member 123 is respectively connected in an articulated manner to the cross strut 125 and to the adjustment traverse 125.

In the outwardly folded position of use of the foot part 119 shown in FIG. 10, the adjustment member 123 has its shortest longitudinal extent between the cross strut 125 and the adjustment traverse 127. If the actuating motor 121 is actuated, the effective length of the control element 131 varies, for example by moving a spindle driven by means of the actuating motor 121 out of a housing. The adjustment traverse 127 is hereby pressed to the rear and is adjusted relative to the frame 117, in particular pivoted in a manner determined by the coupling of the adjustment traverse 127 to the frame 117, as is indicated by the arrow in FIG. 10. This adjustment movement of the adjustment traverse 27 pivots the foot part 119 into the inwardly folded basic position.

The adjustment mechanism, not shown, effective between the foot part 119 and the foot support 119*a* in this respect effects the moving in of the foot support 119*a*. This movement of the foot support 119*a* is derived from the pivot movement of the foot part 119.

Figure 11:
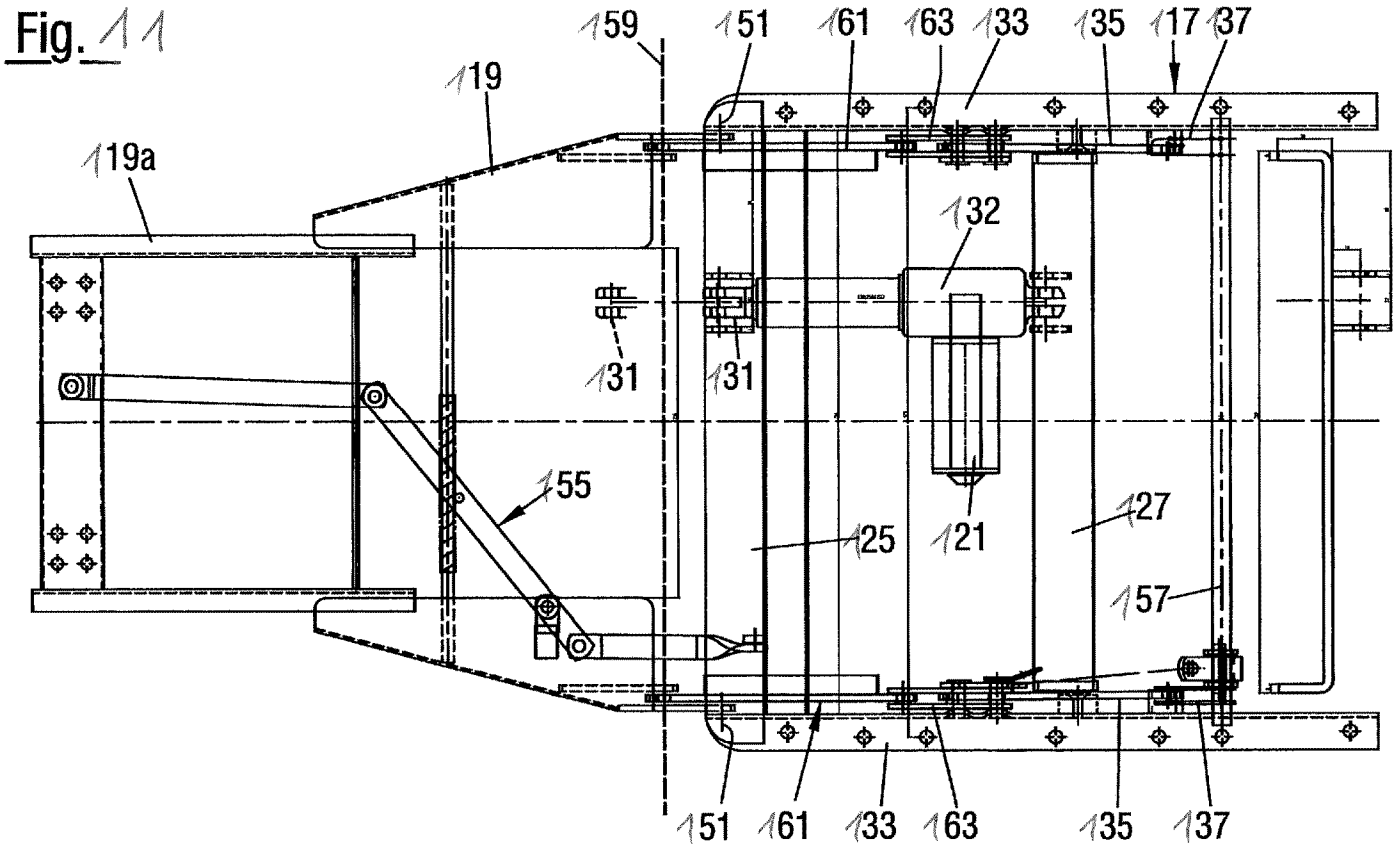
FIG. 11 shows a detailed plan view of the footrest arrangement of FIG. 10.

In the detailed plan view of a footrest arrangement in accordance with the invention in accordance with FIG. 11, a lever arrangement 155 is shown that effects the displacement of the foot support 119*a* relative to the foot part 119 when the foot part 119 is pivoted relative to the frame 117. Such a concept is generally known so that it will not be looked at in any more detail.

Figure 12:
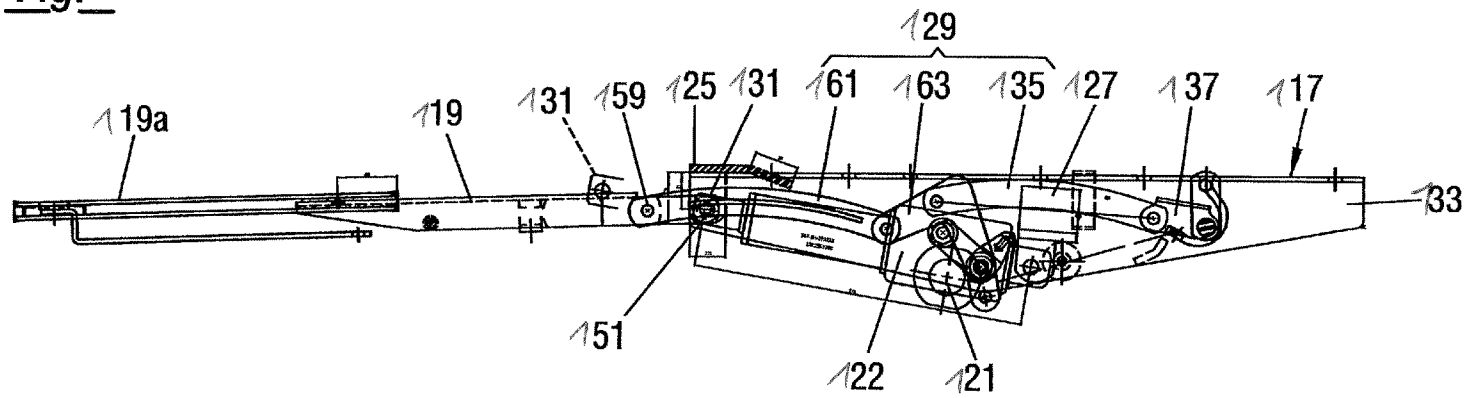
FIG. 12 shows a side view of the footrest arrangement of FIG. 11 in an outwardly folded position of use.
Figure 13:
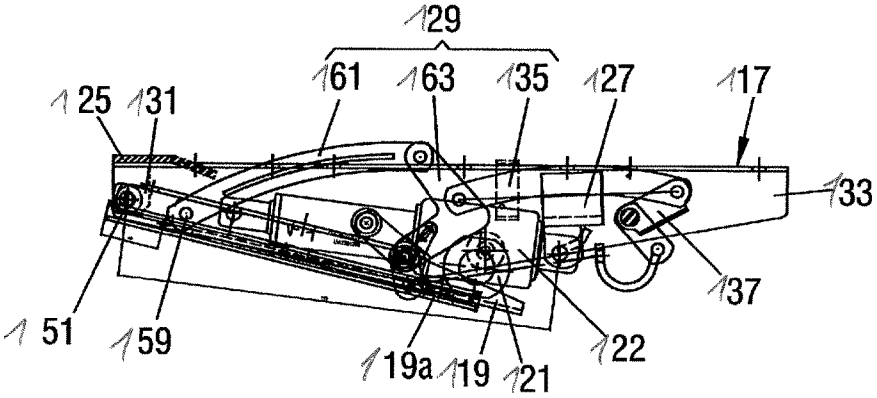
FIG. 13 shows a side view of the footrest arrangement of FIG. 11 in an inwardly folded basic position.

Side views of the footrest arrangement in accordance with FIG. 11 are shown in FIGS. 12 and 13. FIG. 12 shows the outwardly folded position of use, whereas FIG. 13 shows the inwardly folded basic position.

The adjustment traverse 127 is connected to the two side struts 133 of the frame 117 in an articulated manner at the left and right respectively by an arcuate lever 127 and a lever 173 coupled in an articulated manner via a crossbar 147 rotatable relative to the frame 117. The adjustment arrangement 129 comprises the arcuate levers 135 as well as two further lever pairs 163, 161. The arcuate levers 161 are each coupled in an articulated manner to the foot part 119 about an axis 159. This axis 159 is spaced apart from the pivot axle 151 about which the foot part 119 is pivotable relative to the frame 117.

The two middle levers 163 of the adjustment arrangement 129, that each comprise two lever arms extending approximately at right angles to one another, are each coupled between the two arcuate levers 161, 135 and are connected in an articulated manner to the respective side strut 133.

FIGS. 11 to 13 additionally show the actuating motor 121 as well as a housing 122 having the control element 131 movable in and out by means of the actuating motor 121. The effective length of this adjustment member between the front cross strut 125 and the rear adjustment traverse 127 is varied by moving the control element 131 in and out for acting on the adjustment traverse 127 and thus for pivoting the foot part 119. For illustration, the end region of the control element 131 by which the control element 131 is coupled to the front cross strut is also shown in FIGS. 11 and 12 showing the outwardly folded position of use in the moved out position relative to the front cross strut 125 that would result if the control element 131 were to be moved out without moving the rear adjustment traverse 127. This illustrates the possible length variation of the adjustment member formed by the motor 121, the housing 122 and the control element 131.

The comparison of FIGS. 12 and 13 shows how the foot part 119 is pivoted over the adjustment arrangement 129 by the movement of the rear adjustment traverse 127.

To fold the foot part 119 inwardly into the basic position in accordance with FIG. 13, starting from the outwardly folded position of use in accordance with FIG. 12, the control element 131 is moved out by means of the actuating motor 121. Since the control element 131 is supported at the front cross strut 125 fixed to the frame, the rear adjustment traverse 127 is hereby pressed to the rear and is pivoted in so doing. To pivot the foot part 119 back into the position of use in accordance with FIG. 12 again, the control element 131 is moved in again, whereby the adjustment traverse 127 is again pulled to the front and pivoted back.

In accordance with the invention, the adjustment traverse 172 pivotable to the front and to the rear relative to the frame 117 is acted on from the front in that a construction space is used for the actuating motor 121 and for the adjustment member 123 formed here by the housing 122 and the control element (cf. FIG. 10), namely the space between the front cross strut 125 and the rear adjustment traverse 127.

In this respect, the inward folding of the foot part 119 takes place by reducing the effective length of the adjustment member and the outward folding of the foot part 119 takes place by increasing the effective length of the adjustment member.

Figure 15:
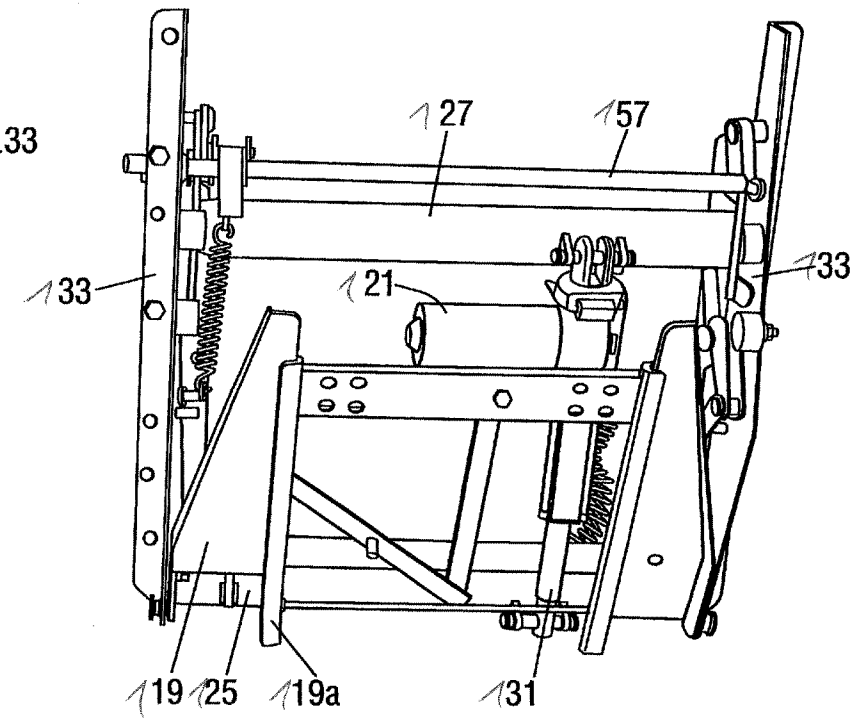
FIGS. 14 and 15 show the footrest arrangement of FIG. 11 from below in the outwardly folded position of use and in the inwardly folded basic position, respectively.
Figure 14:
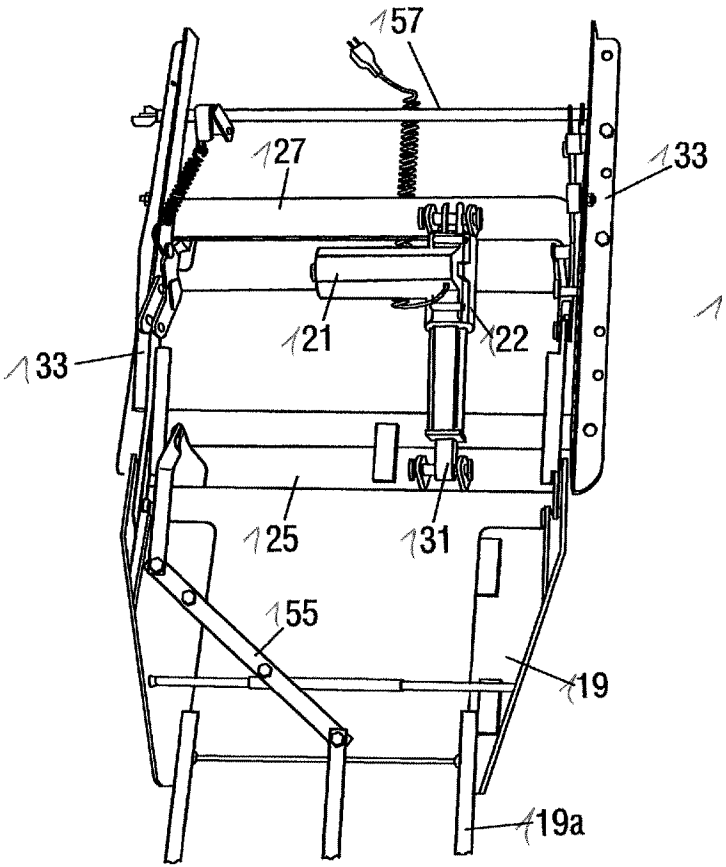

An embodiment of a footrest arrangement in accordance with the invention is shown from below in FIGS. 14 and 15, and indeed in the outwardly folded position of use in FIG. 14 and in the inwardly folded basic position in FIG. 15. The footrest arrangement is shown in FIG. 15 somewhat larger with respect to the representation of FIG. 14.

REFERENCE NUMERAL LIST

11 back part
13 seat part
15 seating surface
17 frame
19 foot part
19*a* foot support
21 actuating motor
22 housing
23 adjustment member
25 front transverse strut
27 rear actuation member
29 adjustment arrangement
31 crossbar
33 actuation tab
35 pivot axle
37 longitudinal axis
39 control element
41 side strut
43 foot
45 lever arrangement
47 rotating rod
49 axis
51 axis
53 tab
55 tab
57 recess
59 board
60 lever
61 lever
63 lever
65 lever
67 lever
69 strut
71 tab
73 lever arrangement
111 back part
113 seat part
115 seating surface
117 frame
119 foot part
119*a* foot support
121 actuating motor
123 adjustment member
122 housing
125 front transverse strut
127 rear adjustment traverse

129 adjustment arrangement
131 control element
133 side strut
135 articulated lever
137 articulated lever
139 pivot axle
141 support hoop
143 base section
145 horizontal section
147 articulated section
149 axis
151 axle
153 axle
155 lever arrangement
157 crossbar
159 axis
161 lever
163 lever

The invention claimed is:

1. Seating/reclining furniture having a back part, a seat part and an adjustable footrest arrangement that is pivotable between an inwardly folded basic position beneath a seating surface of the seat part and an outwardly folded position of use relative to the seat part, the footrest arrangement comprises a frame and a foot part pivotable relative to the frame;

an adjustment member variable in length by means of an actuating motor is supported for pivoting the foot part at a front cross strut fixed to the frame and is connected to a rear actuating member rotatable relative to the frame;

the rear actuating member is connected to the foot part via an adjustment arrangement;

the actuation member comprises a crossbar that is rotatably supported at the frame, that is rotatable by means of the adjustment member and whose rotation can be converted into an adjustment movement of the adjustment arrangement, and the adjustment member is connected in an articulated manner to an actuating tab rotationally fixedly connected to the crossbar.

2. The furniture in accordance with claim 1, wherein a pivot axle about which the adjustment member and the actuating tab are pivotable relative to one another does not intersect a longitudinal axis along which the adjustment member is variable in length.

3. Seating/reclining furniture having a back part, a seat part and an adjustable footrest arrangement that is pivotable between an inwardly folded basic position beneath a seating surface of the seat part and an outwardly folded position of use relative to the seat part, the footrest arrangement comprises a frame and a foot part pivotable relative to the frame;

an adjustment member variable in length by means of an actuating motor is supported for pivoting the foot part at a front cross strut fixed to the frame and is connected to a rear actuating member rotatable relative to the frame;

the rear actuating member is connected to the foot part via an adjustment arrangement; and the adjustment member comprises the actuating motor and a housing having a control element that can be moved in and out by means of the actuating motor, with the actuating motor, the housing, and the control element being arranged between the front cross strut and the rear actuating member.

4. The furniture in accordance with claim 3, wherein the frame comprises a left side strut and a right side strut, with the side struts being connected to one another by the front cross strut.

5. The furniture in accordance with claim 3, wherein the foot part has a foot support that is movable between a moved in basic position and a moved out position of use, with the movement of the foot support being derived from the pivot movement of the foot part.

6. The furniture in accordance with claim 3, wherein the rear actuating member is additionally coupled to a mechanism for lowering a seat, with the seat lowering being simultaneously actuated with an adjustment of the foot part.

7. Seating/reclining furniture having a back part, a seat part and a footrest arrangement that is adjustable by a motor and that is pivotable between an inwardly folded basic position beneath a seating surface of the seat part and an outwardly folded position of use relative to the seat part, the footrest arrangement comprises a frame and a foot part pivotable relative to the frame;

an adjustment member that is variable in length by means of an actuating motor is supported for pivoting the foot part at a front cross strut fixed to the frame and is connected to a movable rear adjustment traverse;

the adjustment traverse is connected to the foot part via an adjustment arrangement; and the adjustment member comprises an actuating motor and a housing having a control element that can be moved in and out by means of the actuating motor, with the actuating motor, the housing, and the control element being arranged between the front cross strut and the rear adjustment traverse.

8. The furniture in accordance with claim 7, wherein the frame comprises a left side strut and a right side strut, with the side struts being connected to one another by the front cross strut.

9. The furniture in accordance with claim 8, wherein the rear adjustment traverse is respectively connected to the side struts of the frame via one or a plurality of mutually connected articulated levers.

10. The furniture in accordance with claim 7, wherein the frame is substantially of U shape and is open to the rear.

11. The furniture in accordance with claim 7, wherein the foot part has a foot support that is movable between a moved in basic position and a moved out position of use relative to the foot part, with the movement of the foot support being derived from the pivot movement of the foot part.

12. The furniture in accordance with claim 7, wherein a construction space for the footrest arrangement is provided beneath the seating surface of the seat part and is bounded to the rear by the back part extending up to and beneath the seating surface or up to and beneath the seat part.

13. The furniture in accordance with claim 7, wherein the back part is pivotably connected to the seat part about a pivot axle and is adjustable in inclination with respect to the seat part.

14. The furniture in accordance with claim 7, wherein a cantilever chair support structure supporting the seat part and the back part is provided that has at least one support hoop that comprises a base section, an at least approximately horizontally extending horizontal section and an articulated section connecting the base section and the horizontal section to one another and allowing a pivoting of the horizontal section relative to the base section, with the back part being pivotably supported at the horizontal section about a horizontal axis and with the seat part being movably guided in a compulsory manner along the articulated section.

* * * * *